US008020481B1

(12) United States Patent
Beckwith

(10) Patent No.: US 8,020,481 B1
(45) Date of Patent: Sep. 20, 2011

(54) SYSTEMS AND METHODS FOR MODULAR AREA DENIAL

(75) Inventor: Brian T. Beckwith, Phoenix, AZ (US)

(73) Assignee: TASER International, Inc., Scottsdale, AZ (US)

( * ) Notice: Subject to any disclaimer, the term of this patent is extended or adjusted under 35 U.S.C. 154(b) by 602 days.

(21) Appl. No.: 12/118,657

(22) Filed: May 9, 2008

(51) Int. Cl.
*F41F 7/00* (2006.01)

(52) U.S. Cl. ..... 89/1.1; 89/1.11; 235/400

(58) Field of Classification Search ..... 89/1.1, 89/1.8, 1.11; 709/204–207; 235/400
See application file for complete search history.

(56) References Cited

U.S. PATENT DOCUMENTS

H1009 H * 1/1992 Prapas et al. ..... 89/36.08
5,546,124 A 8/1996 Scerbo, III
5,828,301 A 10/1998 Sanchez
7,549,365 B2 * 6/2009 Root, Jr. ..... 89/1.819
7,631,452 B1 * 12/2009 Brundula et al. ..... 42/1.08
2009/0323248 A1 * 12/2009 Brundula et al. ..... 361/232

FOREIGN PATENT DOCUMENTS

FR 2676536 A1 * 11/1992
WO WO 0113217 A1 * 2/2001

* cited by examiner

*Primary Examiner* — Bret Hayes
*Assistant Examiner* — Joshua Freeman
(74) *Attorney, Agent, or Firm* — William R. Bachand

(57) ABSTRACT

A system for performing a function with respect to a zone includes a controller, a network, and a plurality of subsystems. The controller issues a first series of commands. Each command of the first series has a first ordinal. The plurality of subsystems is coupled to the controller via the network. A particular subsystem determines a role in accordance with a physical position of the particular subsystem relative to another subsystem of the plurality of subsystems. The particular subsystem counts commands of the series to determine for a particular command the first ordinal. The particular subsystem performs a function with respect to the zone in accordance with the particular command of the series, in further accordance with the first ordinal, and in further accordance with the role.

33 Claims, 2 Drawing Sheets

SYSTEMS AND METHODS FOR MODULAR AREA DENIAL

BRIEF DESCRIPTION OF THE DRAWING

Embodiments of the present invention will be described with reference to the drawing, wherein like designations denote like elements, and.

DETAILED DESCRIPTION OF THE PREFERRED EMBODIMENTS

A system, according to various aspects of the present invention, includes a controller and a plurality of subsystems. An installation of the system may include one controller and any number of subsystems. The controller may be coupled to the subsystems via a wired medium and/or a wireless medium for power and/or data communication. The controller may communicate with the subsystems without the subsystems being previously uniquely configured with an address. Each subsystem may have one role from a finite ordered set of roles. A role may be identified by its ordinal in the ordered set of roles. Each subsystem may determine its role in the installed system. For any one role of the set, zero or more subsystems may determine themselves to have that role. A role may be determined by a physical position of a subsystem with respect to the controller and/or other subsystems. According to what is referred to herein as ordinal based communication, a subsystem takes action on commands of the same ordinal as its role and otherwise ignores other commands. Using ordinal based communication simplifies initial installation of the controller and subsystems, exchange of a controller or subsystems for maintenance, rearrangement of subsystems for different objectives, addition of subsystems, and removal of subsystems.

Figure 1:
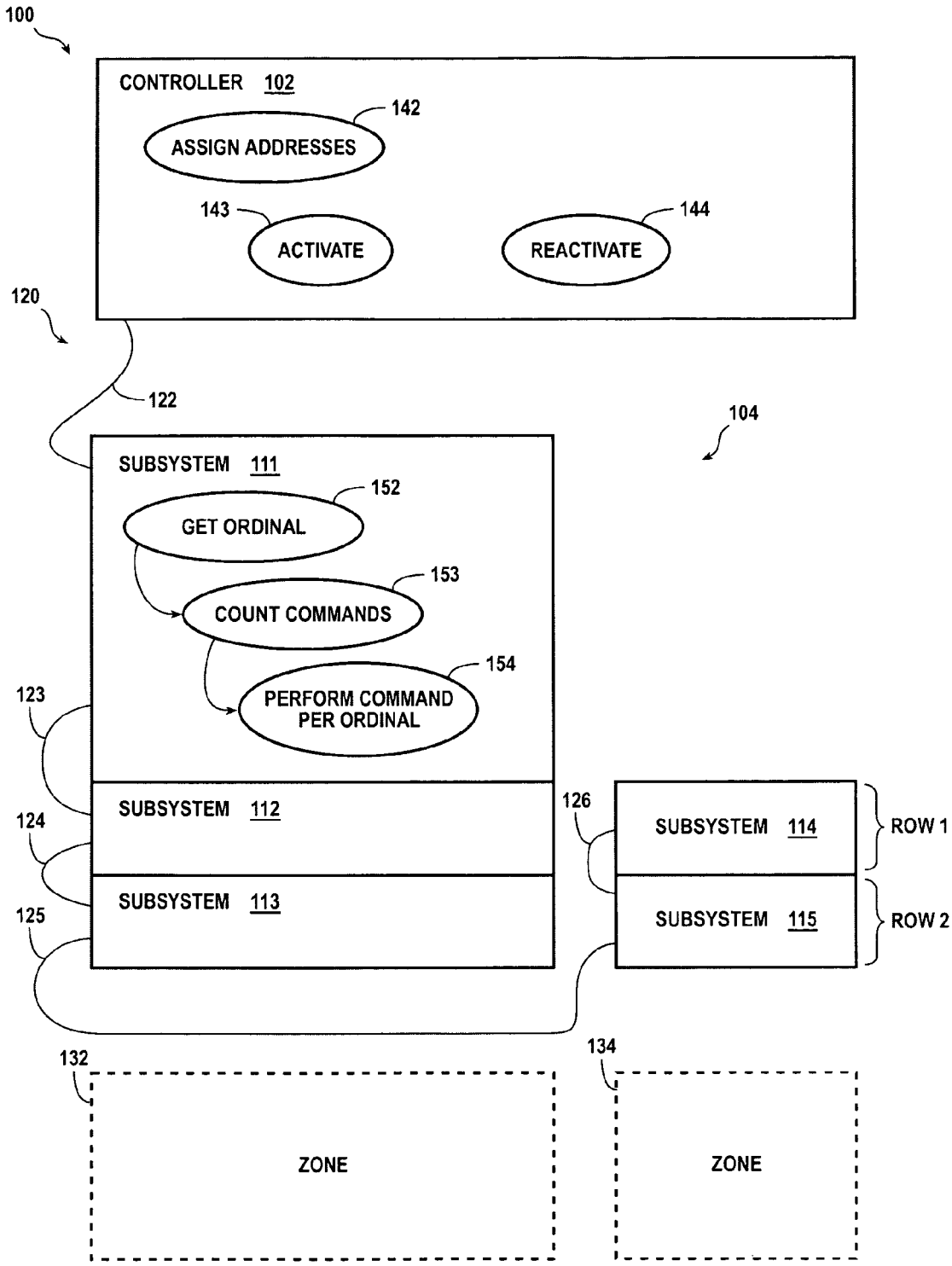
FIG. 1 is a functional block diagram of a system that may use ordinal based communication, according to various aspects of the present invention.

For example, system 100 of FIG. 1 may be installed to perform any useful function (e.g., launching a projectile into a zone) with respect to one or more physical zones 132, 134 where a plurality of subsystems 104 is installed so that each subsystem acts on a zone or on a portion of a zone. A portion of a zone may be unique and subsystems may take exclusive actions as to their respective unique portion of the zone. Portions may overlap for improved reliability and/or improved effectiveness. Several subsystems may, as to the same zone, take unique actions (e.g., different amounts of force, different types of force) or redundant actions (e.g., first application of force, second application of the same type of force as the first application). System 100 includes a controller 102, a network 120, and a plurality of subsystems 104 of which subsystems 111-115 are exemplary. Subsystems 111-113 act on zone 132 and subsystems 114-115 act in a similar manner on zone 134 where zones 132 and 134 may be arbitrary in shape, may be physically distinct, and may be separated. Subsystems of the plurality may be substantially identical to affect each zone according to the same useful function. Subsystems 111-115 may be identical. according to a preferred system design that facilitates adding further identical subsystems as desired.

A controller includes any apparatus that issues commands over a network to control two or more subsystems. For example, controller 102 includes a circuit that may perform an assign-addresses process 142, an activate process 143, and a reactivate process 144; and includes a suitable network interface to support network 120.

A command may instruct a subsystem via network 120 to perform the useful function (e.g., activate, reactivate) as discussed above. A command may instruct a subsystem to initialize or change its configuration and/or accept software and/or data from the controller. A command may request a report from a subsystem via network 120. A command may instruct all subsystems to perform the useful function concurrently, simultaneously, or in turn (e.g., according to the role of each subsystem). A command may instruct all subsystems to change configuration and/or accept software and/or data in one broadcast from the controller. A command may request a series of reports from subsystems. The series of reports may be transmitted in a sequence according to the role of each subsystem.

Activate process 143 may be initiated and/or controlled by a user. A controller may include a user interface (not shown), so that a user may initiate the issuance of one or more commands and/or affect the scope and content of one or more commands. A controller may omit a user interface and initiate the activate process automatically. A controller may include any number of conventional sensors (not shown) that trigger or govern activate process 143. Sensors may include timers, receivers, and/or detectors that detect that a measured quantity crosses a threshold. Receivers may receive messages from network 120 and govern activate process 143 in response to message reception and/or message content.

A reactivate process 144 may be initiated in response to action by a user via a user interface of controller 102 (not shown) or by movement of the target detected by subsystem 111 (detector not shown). A reactivate process may perform all or a portion of activate process 143 for a repeated effect on zones 132 and/or 134.

A network couples components via links for communication. A network may permit any component of a system to communicate with any other component of the system. Network 120 may support communication wherein any one component of system 100 (e.g., 102, 111) may broadcast data to any number of other components (e.g., 112). For example, network 120 includes any conventional medium (e.g., wired, wireless radio, wireless infrared), any conventional interface to the medium (e.g., cable driver circuits, sensors, receivers, transmitters), and analog and/or logic circuitry (e.g., modulation/demodulation, message formatting/parsing, protocol handling). The logic may be implemented with software to perform communication among similar or dissimilar components (e.g., any controller 102, any subsystem 111-115). Any conventional protocols may be used. Network 120 may include one physical form and protocol stack or may comprise multiple physical forms and various protocol stacks joined, for example, by conventional bridge technology. In a preferred network, according to various aspects of the present invention, network 120 and links 122-126 include a wired daisy-chain of identical cables.

According to an important aspect of the present invention, the controller 102 need not be aware of the quantity of subsystems 104 or the physical arrangement of subsystems 104 yet control of subsystems may still be organized by roles and responsive to roles as discussed above. Consequently, the quantity of subsystems 104 and the arrangement of subsystems 104 may be changed without change to controller 102 and/or change to activate process 143.

A link couples a component to a network. A link may be wired or wireless regardless of whether the entire network is wired and/or wireless. A link may support communication continuously or at intervals of time. Intervals may depend on availability of network resources, extent of interference with the network (e.g., noise), and/or network traffic (e.g., link is operative when communication is necessary for a command or a reply).

A subsystem may perform a useful function with respect to a zone and in accordance with a role. A zone may include a physical area and/or a physical volume. A subsystem may affect the zone (e.g., extinguish a fire detected in the zone). A subsystem may affect humans or animals that may from time to time be within the zone. A subsystem may at any time or from time to time determine its role. For example, subsystem 111 includes get-ordinal process 152, count-commands process 153, and perform-ordinal-command-per-role process 154.

A get-ordinal process determines an ordinal for a subsystem with respect to a plurality of subsystems. A definition of the set (e.g., who is a member and not a member), its criteria for order (e.g., who is first and next), and ordinals (e.g., integers starting with zero, integers starting with 1) are suitably a matter of system design prior to the implementation of a get-ordinal process. Order of the set of subsystems 104 may depend on physical arrangement (e.g., proximity of one to another, distance from a geographic reference point, along a compass sweep around a geographic reference point, on an ordered matrix defined for a geographic area or volume), temporal arrangement (e.g., chronology of each subsystem being connected to another member of the set assuming connections are strictly sequential), and/or electrical arrangement (e.g., connected to a termination of a daisy-chain, next to the subsystem that is connected to the termination of the daisy-chain, and so on). Order may refer to physical proximity relationships between subsystems (e.g., above, below, left, right, behind, before).

In a preferred implementation, a set of subsystems includes three members: bottom, middle, and top when the subsystems are stacked vertically. Get-ordinal process 152 may determine by any proximity detecting technology a relationship of subsystem 111 and its neighbor 112 and/or its other neighbors (if any). Get-ordinal process 152 may specify an ordinal according to a predefined ordered set of relationships. For example, ordinal 1 may indicate "bottom", ordinal 2 may indicate "middle", and ordinal 3 may indicate "top". For example, consider an installation of 5 subsystems 104 in 2 separate stacks that includes two "bottom" subsystems having a role ("first in turn") associated with the ordinal 1; 2 "middle" subsystems having a role ("second in turn") associated with the ordinal 2; and 1 "top" subsystem having a role ("third in turn") associated with the ordinal 3. In this example, a role is equivalent to a positional ordinal or row.

A count-commands process may determine an ordinal for each command that a subsystem receives from a network. When each of the plurality of subsystems 104 receives all commands issued by activate process 143, counting in each subsystem 111-115 is concurrent and consistent. For example, subsystem 111 receives commands issued by activate process 143 via link 122 of, network 120. Count-commands process 153 is initialized by receiving an initialization command. Count-commands process 153 thereafter counts commands of a predetermined type (e.g., commands) as evident from content of the command (e.g., a message header, command type field). The count of each particular command type corresponds to a respective temporal ordinal.

For example, when subsystems 104 each include a launch function to be performed in response to a launch command, the first launch command received after initialization is associated by the count-commands process with the temporal ordinal "1"; the second launch command is associated with the temporal ordinal "2"; and so on. When all subsystems of plurality 104 are initialized prior to issuing any launch commands launch-row process 143, all subsystems identify the same ordinals to the same launch commands. Subsystems 113 and 115 may launch projectiles into zones 132 and 134 first in turn. Subsystems 112 and 114 may launch projectiles into zones 132 and 134 second in turn.

A perform-ordinal-command-per-role process compares the ordinal of a command to the ordinal of a role and performs the command when the ordinal of the role is consistent with the ordinal of the command. In the example installation of 5 subsystems discussed above, consider further that each subsystem is responsive to launch commands as discussed above. A launch command issued first in time thereby having temporal ordinal 1 causes only the 2 bottom subsystems having positional ordinal 1 to concurrently perform their respective launch functions according to their role being first in turn; a subsequent launch command issued second in time thereby having temporal ordinal 2 causes only the 2 middle subsystems having positional ordinal 2 to concurrently perform their respective launch functions according to their role being second in turn; and a further subsequent launch command issued third in time thereby having temporal ordinal 3 causes only the 1 top subsystem having positional ordinal 3 to perform its respective launch function according to its role being third in turn.

Ordinal based communication accomplishes salvo operation (e.g., salvo launching) in system 100 as discussed above without unique addresses for subsystems 104. In response to a command requesting a reply, all subsystems of the same role may reply simultaneously. Simultaneous reply may be beneficial when the request (i.e., a command to reply) seeks information that may be cumulative. For example, a cumulative reply to a request seeking to determine if any subsystem is "ready" is satisfactory because simultaneous replies may be logically "or-ed" by the communication medium.

Count-commands process 153 and perform-command-per-ordinal-process 154 may cooperate to obtain cumulative "capability to launch" replies from each role (row) by issuing a suitable request and repeating the request for each additional role (row).

When system 100 does not employ communication based on unique subsystem addresses, then assign-addresses process 142 may be omitted.

System 100 may in addition or alternatively employ communication based on unique subsystems addresses. For example, system 104 may each have the ability to selectively interrupt or maintain (e.g., repeat) command transmission on network 120 to all down-stream subsystems. When network 120 is a daisy-chain network, subsystem 111 is down-stream of controller 102; subsystem 112 is down-stream of subsystem 111; and so on due to the arrangement of identical cables 122, 123, 124, 125, and 126 of network 120. Assign-addresses process 142 begins by commanding all subsystems to interrupt down-stream communication. Consequently, subsequent commands on the daisy-chain network are seen only by the first subsystem 111. Subsystem 111 is assigned a unique address (e.g., included in the command from controller 102) and may reply with its role. Subsystem 111 is then commanded to ignore further address assignment type commands and to reinstate down-stream command transmissions. Assign-address process 142 conducts a similar dialog with each subsystem 112-115, assigning a unique address to each subsystem 112-115. After unique addresses are assigned, a command may be directed to and performed by only one subsystem. Performance may include responding with a reply without cumulation as discussed above.

When system 100 does not employ ordinal based communication, then count-commands process 153 may be omitted. After controller 102 learns of the positional ordinal of each subsystem 104, it may accomplish the equivalent of salvo activation by reacting to a single trigger event by sending without interruption a suitable command (e.g., launch) addressed to each subsystem having the same role.

As a further example of a system of the type described with reference to FIG. 1, consider modular area denial system 200 of FIG. 2, installed to deny access to a zone 290. Modular area denial system 200 includes a controller 210 having a user interface and a plurality 230 of identical launchers. Each launcher (e.g., a module) may deny intrusion by animal and/or human intruders to a segment of zone 290. The term 'module' refers to a subsystem having an enclosure that protects its contents and that facilitates handling of the subsystem as a unit, independent of the handling of other subsystems.

An area denial system, according to various aspects of the present invention, inhibits locomotion of a human of animal target with respect to a zone. Successful area denial may be complete as to a human or animal target; or, incomplete yet sufficient as to a particular target. Inhibiting may include deterring further voluntary movement with respect to the zone. Inhibiting may include pain compliance (e.g. sufficiently interfering with locomotion) and/or immobilization (e.g., halting locomotion). Force used to inhibit may be applied to cause pain and/or to immobilize. Immobilization may include electrically disrupting the target's voluntary control of its skeletal muscles. An amount of force applied may be determined with respect to a classification of the target (e.g., kind of animal, human, size), a present location of the target (e.g., more force at locations deeper within the zone), and/or a vector of the target (e.g., velocity and direction of movement of the target). In a simpler implementation, the same force may be used against all classes, locations, and vectors of targets. The amount of force to be applied may be determined by a human operator of the area denial system based on the human operator's observation of the one or more targets approaching or intruding in the zone.

In the system examples discussed herein, force for inhibiting locomotion may include launching toward the target materials (e.g., markers, paper balls, rubber bullets, nets) and/or electrodes (e.g., tethered electrodes, wireless projectiles having electrodes, nets of electrodes, grenades (e.g., secondary launchers) that further launch any types of materials). At least two points are generally used for effectively inhibiting locomotion using electronic current (e.g., stun guns, weapons that launch wire-tethered electrodes, electrified projectiles with wireless electrodes). Therefore, for clarity of presentation systems of the type that conduct a current through at least two electrodes at the target are discussed for illustrating the invention. The two points of impact may involve two wire-tethered electrodes, an electrified projectile that deploys at least two electrodes, or a combination of wire-tethered and wireless electrodes. Electrodes are considered wireless when the circuit for passing a current through the target does not include tether wires from a launcher to the target.

An area denial system, according to various aspects of the present invention, may perform a warning action and/or deploy a force against a target to inhibit locomotion of a target with respect to a zone. An area denial system may perform a warning action (e.g., scare, confuse, verbal warning) that deters a target from entering a zone or persuades the target to voluntarily change course and/or leave a zone.

A warning action may include making a loud noise (e.g., siren, alarm, bell), producing an audible and/or visible electric arc, detonating a flash-bang munition, and issuing an audible verbal warning. A human operator may specify the type of warning action.

An area denial system may take action to deploy a force against a target. A force deployed by an area denial system may be such as to have lethal effect to a high probability. Such force is herein called lethal force, for simplicity, realizing that unsuccessful deployments may be non-lethal. A force deployed by an area denial system may be such as to have a non-lethal effect to a high probability. Such force is herein called non-lethal force, for simplicity, realizing that improbable deployments may be lethal.

A lethal force may permanently halt target locomotion through a zone. A non-lethal force may temporarily halt locomotion of the target so that conventional methods may be used to arrest the target (e.g., a guard affixing shackles and/or handcuffs to the target).

Functional goals of an area denial system, according to various aspects of the present invention, include adversely affecting every instance of a desired type of target that intrudes an area designated as a denial zone so that the target does not proceed through the zone, inhibiting (e.g., halting) locomotion sufficiently for the arrest of every instance of a desired type of target that intrudes the denial zone, exhibiting a high degree of accuracy in deployment of non-lethal force, exhibiting a high probability of effective deployment of force, exhibiting a low probability of false alarm, exhibiting a low probability of insensitivity to the desired type of target, and facilitating, as discussed above, the initial installation of the controller and subsystems, exchange of a controller or subsystems for maintenance, rearrangement of subsystems for different objectives, addition of subsystems, and removal of subsystems. Systems and methods of the present invention provide superior performance in contrast to prior art systems by accomplishing a combination of these functional goals.

Passing a current through a human or animal target may cause pain and/or halt locomotion. Preferably, the current through a target halts locomotion by overwhelming voluntary control of target skeletal muscles by the target. Various examples of currents that accomplish halting of locomotion, circuits that produce such currents, and methods of producing such currents are described in the various subsystem descriptions herein. Systems and methods according to the present invention may include any of the described currents, circuits, and methods of producing such currents.

A circuit may be formed to provide a current through a target. The circuit may include a signal generator that provides the current. An area denial system may detect a target and make a target a part of a circuit for delivery of the current. The target may become a part of a circuit voluntarily and/or involuntarily.

A target may voluntarily come into contact with such a circuit by moving into contact with terminals (e.g., walking onto a mesh of terminals, grasping one or more terminals to traverse an obstacle, falling against terminals).

A target may involuntarily come into contact with such a circuit by moving proximate to terminals that ionize the air to establish a circuit with the target (e.g., a local stun function). An area denial system may propel electrodes toward a target for impact with the target to establish the circuit to deliver the current (e.g., a remote stun function). The electrodes may be wire-tethered to a launch device; or (e.g., wireless) coupled to a projectile that may be launched toward a target without a wire-tether to the launch device.

Wire-tethered electrodes may separate upon launch and may then fly diverging paths toward the target. A distance between a launch device and a target may determine electrode spacing upon impact with the target or upon reaching a maximum length of the wire tether (e.g., 15 to 35 feet (5 to 10 meters) from the target).

An electrified projectile may include a power source (e.g., a battery), a signal generator (also herein called a waveform generator), and electrodes for a remote stun function. An electrified projectile may be launched from a cartridge or round, mounted to or in a launcher.

An activate process 143 performed in system 200 may launch pairs of wire-tethered electrodes into zone 290 for completing a circuit through tissue of a target. A stimulus current may be conducted through the target for a period (e.g., 30 seconds). A reactivate process 144 performed in system 200 may repeat the stimulus current for an additional period (e.g., 30 seconds). A reactivate process may reactivate an electrified projectile via a suitable wireless link to the projectile.

Figure 2:
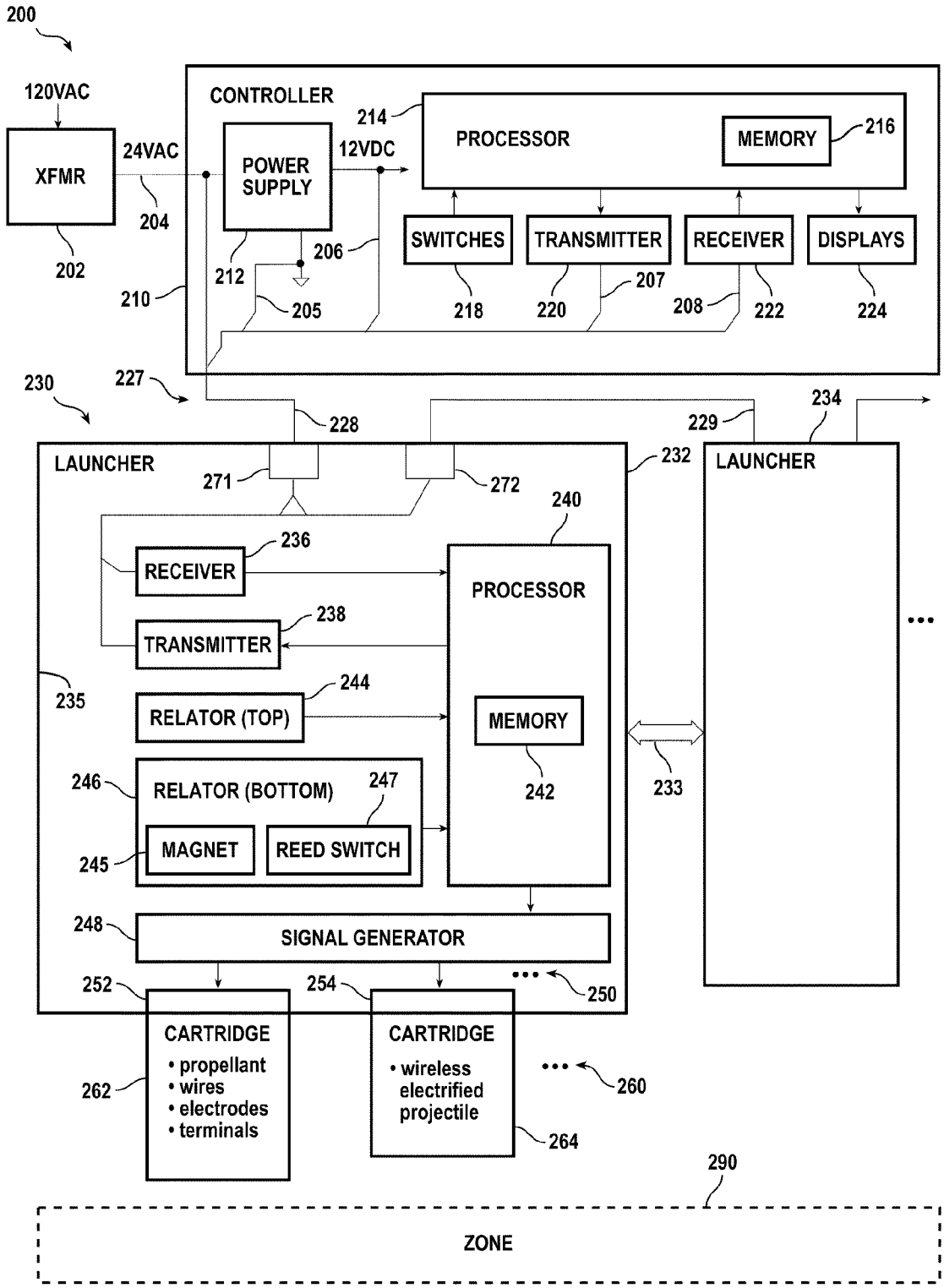
FIG. 2 is a functional block diagram of a modular area denial system, according to various aspects of the present invention.

Modular area denial system 200 of FIG. 2, according to various aspects of the present invention, denies passage through a zone 290 by deploying non-lethal force that halts locomotion of targets in zone 290. The user may then approach the target and apply other permanent restraints. System 200 includes transformer 202, controller 210, and a plurality 230 of launchers of which launcher 232 is exemplary.

Transformer 202 reduces utility electric power (e.g., 120 volts alternating current) to a suitable lower voltage to more easily meet electrical safety codes.

A controller may provide power to launchers and may further include a user interface. For example, controller 210 is a controller of the type discussed above with reference to controller 102 having all its functions. Controller 210 receives 24-volt alternating current 204 from transformer 202 and provides output signals to launchers 230 including 24-volt AC 204, circuit ground 205, 12-volt direct current 206, and command signal 207. Controller 210 further receives from launchers 230 report signal 208. Controller 210 may include power supply 212, processor 214 having memory 216, switches 218, transmitter 220, receiver 222, and displays 224.

Power supply 212 rectifies AC current to provide DC current in any conventional manner. The 12-volt DC signal 206 provides power to all suitable components of controller 210.

Switches convert manual operations by the user into signals used to issue commands. For example, switches 218 provide signals used by transmitter 220 and/or processor 214. Switches 218 may include a toggle switch for the user to toggle between a safety-on state and a safety-off state; a momentary push button switch for the user to trigger launching and flow of stimulus current through the target for a period; and a momentary push button switch for the user to cause a repeat of the stimulus current through the target for an additional period.

A message may include a command and/or a report. A command issues from any controller process 142, 143, 144, discussed above. A command may be recognized by any launcher (e.g., by a command type field of the message) for reconfiguration, software transfer (to/from subsystem), request for status, safety-off (e.g., a request to reinitialize), safety-on, launch, and stimulate functions. A report issues from any subsystem in response to a suitable request type of command.

A command signals a subsystem to perform a particular function including any particular useful function with respect to the zone. The set of commands designed for a subsystem may include several different particular useful functions related to a zone. For example, a launcher may respond to a particular launch command for each of several types of cartridges and/or rounds. Types of cartridges and/or rounds may differ in any suitable aspect, for example, range (e.g., effective distance from the launcher to the target) and/or style (e.g., wire-tethered, wireless projectile, net). As another example, launch commands may differ for different denial actions (e.g., warn the target, mark the target, pain compliance, inhibit locomotion, halt locomotion). In accordance with ordinal based communication as discussed above, by repeating a particular type of command (e.g., forming a series of identical commands that are counted by each subsystem), each subsystem in turn by role will perform the action requested by the command.

A report informs the controller of the current state and status of a subsystem. State and status may describe initialization complete/incomplete, configuration complete/incomplete, identification of installed software, quantity of available cartridges and/or projectiles, battery capacity, role, and/or built in test equipment test results. In accordance with ordinal based communication as discussed above, by repeating the command requesting a report (e.g., forming a series of identical commands that are counted by each subsystem), each subsystem in turn replies with its report.

A transmitter issues commands to a network as discussed above. Transmitter 220 receives signals from switches 218 and/or processor 214. Transmitter 220 may determine whether a message is to be sent, the message content, format, and modulation. In an implementation where processor 214 is omitted, transmitter 220 performs issue-commands process 104. Otherwise, processor 214 and/or transmitter 220 may perform issue-commands process 104; and access to switches 218 by transmitter 220 may be omitted.

A receiver receives a report from a network as discussed above. Receiver 222 receives messages comprising reports and passes information derived from the reports to processor 214 and/or operates displays to inform the user of the content of the reports. Receiver 222 may demodulate, parse, and take suitable action on the values of fields conveyed by the report. In an implementation where processor 214 is omitted, receiver 222 includes all necessary structures and functions to operate displays 224. Otherwise, processor 214 and/or receiver 222 may suitably divide the functions of receiving and operating displays; processor 214 may store reports in memory for access by other systems (not shown); and access by displays 224 to signals from receiver 222 may be omitted.

Displays present information to a user in any conventional manner. Displays 224 may include LEDs for status of voltages 24 VAC and 12 VDC, safety on/off, and/or the availability and contents of launcher arsenals.

A processor performs a stored program to implement a process as discussed herein. A processor is a type of circuit that may include memory for instructions for the stored program (e.g., microcode, assembly language, instructions in higher level languages); an engine (e.g., a state machine, arithmetic-logic unit, interpreter) for performing the stored program; and any support circuitry for efficient operation (e.g., signal conditioning, signal processing, logic arrays, logic gates, registers, counters, sensors, input/output control, communications).

A daisy-chain network is a network having a series topology among subsystems. Except for the first and last members, each member of the network receives on a cable from one source a group of signals and provides the same signals on a cable to the next subsystem in series. Each subsystem may have circuitry to determine that it is a first or last member of the network (e.g., a terminal node). For example, cables 228 and 229 and following (if present) comprise a daisy-chain network 227 for members including controller 210, launcher 232, and launcher 234. Controller 210 is a terminal node. In the absence of additional cables, launcher 234 is a terminal node. In a preferred implementation, neither controller 210 nor any launcher 230 determines whether it is a terminal node or takes action based on being a terminal node. Consequently, launchers may be connected into or disconnected from the daisy-chain network in any temporal sequence without changes to controller 210 or changes to processes using ordinal based communication.

Changes to the network 227 are preferably made with safety switch 218 in the safety-on position. After network changes are completed, safety switch 218 is moved to the safety-off position. Subsystems may detect the application of 24-volt AC signal 204 and repeat get ordinal process 152. Controller 210, processor 214, and/or transmitter 220 may detect the safety-off state and may begin assign-addresses process 142 to issue one or more commands for initialization of every launcher now on the daisy-chain network.

A launcher includes any apparatus that operates a propellant to launch a projectile. The propellant may be packaged with the projectile (e.g., a round, cartridge) or otherwise supplied to the launcher (e.g., compressed air line). For example, launchers 230 include a plurality 260 of cartridges aimed to strike a target in each respective portion of zone 290 for establishing a current through the target as discussed above. An angular offset for each cartridge (not shown) aims each identical cartridge 262, 264 at each portion of zone 290. Angular offsets may be fixed by the design of launchers 230 or adjusted by an operator during installation or reloading of launchers 230.

A launcher may launch all cartridges substantially simultaneously. A launcher may launch cartridges in sets (e.g., pairs) where each member of the set presents a recoil force to a center of mass of the launcher that sums with all other recoil forces to a minimum net torque. Minimizing net torque about an axis through the center of mass of the launcher improves accuracy by avoiding turning the launcher away from its intended direction of aiming. A launcher may be designed to accept any number of cartridges and any number of sets of cartridges.

A cartridge may include an electrically activated propellant and a propelled pair of wire-tethered electrodes for a remote stun function on a human or animal target. For example, cartridges 260 are of the conventional type marketed by TASER International for use with models M26 and X26 electronic control devices.

A user may install system 200 by placing controller 210 at a safe location that may have utility power for transformer 202 and has a suitable view of zone 290. A suitable number of launchers 230 may be positioned and aimed to deny access to zone 290. Launchers may be positioned next to each other to indicate by relationship 233 an ordered set of launches into the same or different portions of zone 290. In this example, the electrical position of a subsystem on daisy-chain 227 is not material to ordinal based communication for system 200. Consequently, cables 228 and 229 and so on (as needed) may be connected in any manner.

For example, when launcher 234 is stacked on top of launcher 232, relationship 233 indicates respective roles for a first salvo launch (cartridges 262 and 264) responsive to a first launch command from transmitter 220 and a second, similarly aimed salvo launch from launcher 234 responsive to a second launch command from transmitter 220. Similarly aimed salvos may be suitable for area denial by multiple simultaneous intruders. In another implementation, when launcher 234 is placed beside launcher 232 (or launchers 232 and 234 are aimed differently), relationship 233 indicates respective roles for a first salvo launch responsive to a first command into a first portion of zone 290 where an intruder is expected to enter; and a second salvo launch responsive to a second command into a second portion of zone 290 where an intruder is expected to be if the first salvo does not succeed in accomplishing area denial.

In system 200, each subsystem may determine its role according to a relation 233 that may exist between sets (e.g., pairs) of subsystems. A set may include a pair of launchers stacked vertically or horizontally. A launcher may have a first role determined according to a first set (vertical stacking) and a second role determined according to a second set (horizontal stacking). Relation indicators and detectors may include sources and sensors of any electromagnetic energy. A source and its sensor may be located at opposite ends of a relation. A source and its sensor may be located at one end of a relation and linked at the other end of the relation by a coupler or reflector.

For example, launchers 230 may be of a type described above with reference to subsystems 104 of FIG. 1. Launcher 232 includes housing 235; a plurality 250 of cartridge sockets through housing 235 of which cartridge socket 252 and cartridge socket 254 are identical and exemplary; network connectors 271 and 272 through housing 235; relators 244 and 246 operative through housing 235 with corresponding relators of other launchers 230; receiver 236; transmitter 238; processor 240; memory 242; and signed generator 248.

Housing 235 may be constructed of materials selected to protect circuits of launcher 232 from environmental factors and permit cooperation of relators among launchers. For example, the entire housing 235 or a suitable portion may be constructed of transparent or translucent material for optical and/or radio coupling between relators; or of magnetic permeable material for magnetic coupling between relators. Relators may be mounted in one or more orifices of housing 235 to be exposed to other relators.

A cartridge socket accepts a cartridge, holds the cartridge so that it is reliably aimed, and couples the cartridge to circuitry of a launcher for activating the cartridge. Activating a cartridge may include activating a propellant to propel electrodes from the cartridge toward a target. Activating a cartridge may include applying a stimulus signal between electrodes of the cartridge to provide a stimulus current through the target to incapacitate the target as discussed above. Activating a cartridge may include producing a warning sound or arc via high voltage discharge across terminals of the cartridge before or after the electrodes have been propelled away from the cartridge. For example, cartridge sockets 252 and 254 accept cartridges 262 and 264 of the type marketed by TASER International otherwise for use with models M26 and X26 electronic control devices. Such a cartridge includes a pair of terminals located at the base of the cartridge for electrical contact with a socket. The cartridge further includes an electrically fired primer coupled to the terminals. A current at a high voltage fires the primer. The primer propels an anvil to rupture a cylinder of compressed gas. The gas that violently escapes the ruptured cylinder pushes two wire-tethered electrodes out of the front of the cartridge with sufficient force for flight and impact with a target prior to reaching the length of the wire tether. Each electrode remains electrically coupled to a respective terminal via its wire-tether for conducting a stimulus current through the target for a remote stun function. In another implementation, rear terminals for igniting the primer are separate from additional front terminals for conducting the stimulus signal. Before igniting the primer, the front terminals facilitate displaying a warning arc across the face of the cartridge and/or facilitate a local stun function. The front terminals, after launch, couple the stimulus current through the tether wires for a remote stun function.

Network connectors 271 and 272 facilitate membership of launcher 232 in a daisy-chain network 227, for example, daisy-chain network 120 discussed above. Signals 204-208 may be common (or buffered) to both connectors 271 and 272 for ordinal based communication. Where interruption of the command signal to down-stream subsystems is desired (e.g., for assigning addresses), signal 208 may be interrupted by a switch controlled by processor 240 and/or receiver 236.

A relator establishes a relationship between launchers. For example, relator 244 may be mounted at the top of housing 235 and relator 246 may be mounted at the bottom of housing 235 for cooperation with oppositely situated relators of other identical launchers. A relator may include an indicator and a detector. The indicator may include a source of electromagnetic energy such as magnetic flux. The detector may include a sensor of electromagnetic energy. Each relator may establish two parallel channels, one facilitating sensing of the relation by a first launcher of the relationship; and a second facilitating sensing of the relation by a second launcher of the relationship. The two channels may use the same type and quantity of electromagnetic energy. In another implementation, the two channels use different types and/or quantities of electromagnetic energy to avoid cross-talk between the channels and undesired coupling of an indicator to a detector of the same relator.

For example, relator 246 includes, as a source, magnet 245; and includes, as a detector, reed switch 247. Relator 244 includes a reed switch and magnet with opposite positional symmetry. Relator 244 is designed to be aligned with a relator (not shown, but herein referred to as relator 246') of another launcher that is stacked and aligned above housing 235. Relator 246 is designed to be aligned with a relator (not shown, but herein referred to as relator 244') of another launcher that is stacked and aligned below housing 235.

A charger (not shown) charges a battery (not shown) that may provide 12-volt DC current to all suitable circuits of launcher 232 and to the network in the absence of sufficient DC current from the network. In the absence of sufficient 24-volt AC current for the charger from network 227 the battery provides 12-volt DC current to all suitable circuits of launcher 232 and may further provide 12-volt DC current to network 227.

A circuit of a launcher may support ordinal based communication, launching, stimulating, and reporting functions as discussed above. For example, processor 240, among other functions, may support ordinal based communication by performing get-ordinal process 152, count-commands process 152, and perform-command-per-ordinal process 154, discussed above.

A receiver receives commands as transmitted by transmitter 220 of controller 210. Receiving may include detecting and demodulating. For example, receiver 236 receives messages transmitted in serial via network 227 and presents data comprising a command to processor 240 for further analysis.

A signal generator generates one or more signals sufficient to activate a cartridge. For example, signal generator 248 provides a high voltage signal to terminals of sockets 250 that activates the propellant of each cartridge accepted by each socket. The high voltage signal also provides a stimulus current through the target for incapacitation as discussed herein. Activation for propelling accomplishes launching (e.g., per activate process 143). Activation for providing the stimulus current accomplishes stimulating, incapacitating, immobilizing, and/or halting of locomotion (e.g., per activate process 143 or reactivate process 144), as discussed herein.

A transmitter transmits a report for being received by receiver 222 of controller 210. For example, transmitter 238 receives status information from processor 240, may format the information to produce a message, and may apply a suitable modulation to produce a serial output signal comprising a report.

Processor 240 may be implemented with any processor as discussed above (e.g., discrete logic and/or microcontroller). For example, processor 240 may include an ordinal circuit, a parser, a counter, and a status circuit and/or software to perform these functions. A parser receives a command from receiver 236 and recognizes a type of command by parsing and comparing to predetermined type codes. Commands of the same type may be received in an uninterrupted series. Commands of a mix of types may be intermixed in any manner.

A counter in cooperation with an ordinal circuit performs count-commands process 118. A counter separately accumulates total occurrence counts of commands for each of several particular types. Counting may be set to zero in response to receiving a command of a type for initialization. When a counter counts to a limit number of commands of one type, the command of that type is performed by launcher 232. Consider 'N' to be the limit number (e.g., the ordinal of the role for this launcher). Then, the Nth command of the same type is performed; commands before the Nth command are counted but otherwise ignored; and with performing of the Nth command, counter 346 is reset to subsequently begin the count again. Counting may begin at zero and proceed to the limit; or begin at the limit and proceed to zero.

An ordinal circuit performs get-ordinal process 116 discussed above. For example, an ordinal circuit receives the results of relators 244 and 246 and determines an ordinal with reference to a predefined series. Where the ordered set is 'no relation', 'bottom', 'top', 'middle', as discussed above, the ordinals may be 0, 1, 2, and 3; and, the role may be the gray code of the ordinal: 0, 1, 3, 2. Where relator 246 is MSB and relator 244 is LSB. Here, 0 corresponds to insufficient magnetic flux to close the aligned proximity switch; and 1 corresponds to sufficient flux to close the aligned proximity switch.

A counter may also complete perform-command-per-ordinal process 120. Continuing with the example discussed above, performing the Nth launch command may include the counter enabling signal generator 248 to perform a launch function. Performing the Nth report command may include the counter enabling a status circuit to initiate a report to be transmitted.

A status circuit collects information describing the state and status of launcher 232. For example, a status circuit may respond to a counter to reply to a command requesting a report. The type of report may be specified by the command.

A denial zone generally includes the trajectories of all possible deployments from an installation of area denial nodes. For example, denial zone 290 is defined by the trajectories of deployments of cartridges from launcher 232 and 234. A warning zone lies beyond a denial zone. A trajectory may extend into a warning zone. That portion of a trajectory that extends into a warning zone may have insufficient accuracy or reliability for normal operation.

A processor may include any conventional hardware (e.g., analog and/or digital circuitry) and software for computing (e.g., performing methods automatically, performing mathematical calculations, responding in accordance with a result of a calculation), receiving data, and/or converting data. A special purpose logic circuit may replace a general purpose processor. A processor may further include data storage (e.g., circuits, drives), peripherals, user interfaces, protocol stacks, operating systems, particular application software, and configuration control software. User interfaces (not shown) may be used for node maintenance, performance evaluation, and monitoring during operation. Functions performed by a processor may include inter alia initiating and responding to network communication, monitoring at least one denial zone, cooperating with signal generator 248 for launching and stimulating one or more targets (e.g., performing launch controls, performing stimulus controls, obtaining status and deployment capabilities, commanding reconfiguration, commanding deployment), tactical coordination among launchers 230, and reporting use of force.

A status circuit may cooperate with a signal generator to determine an effectiveness of a prior deployment of force against a target. A controller (or a user) in response to (or display of) such a status report may make adjustments to improve the effectiveness (or likely effectiveness) of a subsequent action. For example, adjustments may include selecting or changing cartridges, projectiles, and/or criteria as discussed herein. A controller may receive data that indicate, whether a current has been delivered through the target, and a description of such current (e.g., duration of a series of pulses, pulse width, pulse separation, pulse rate, whether ionization potentials were used, charge delivered). A controller may use information indicating that target locomotion has not halted and/or that no current was provided through the target to adjust, inter alia, subsequent prediction of locations of electrode impact (e.g., decrease or use smaller regions of predicted impact).

Status may include a description of a disturbance. Tampering with a node may be a disturbance. Detecting tampering may include detecting vibration, shock, loss of communication capability on a wired link, loss of throughput on a wireless link, or a loss of power.

A launcher deploys a force toward a target. Deployment generally includes propelling an object and/or a gas toward a target. Objects may include sensors, biometric sensors, bugs, nonlethal force (rubber bullets, pepper spray, tear gas, wire-tethered electrodes, electrified projectiles), or lethal force (e.g., electric shock, poisons, bullets, grenades). Launchers 230 may report their capabilities to controller 210. A launcher 232 may detect and report installed cartridges and/or projectiles of various types. Cartridge and projectile types connote capabilities of a deployable force (e.g., effective range, rate of separation with distance, accuracy, impact energy, sensitivity, maximum and minimum physical phenomena detectable). A launch device may report remaining deployment capabilities after a deployment.

Cartridge 262 or plurality of cartridges 260 (e.g., magazines) may include a plurality of wire-tethered electrodes for launching toward a target. Launcher 232 may launch any number of electrodes toward a target. Launch subsystems 230 may stimulate a target to immobilize the target with a current provided through any of the electrodes (e.g., any pair) having suitable relative polarity and contact with the target. A stimulus may include unipolar and/or bipolar pulses of current. A cartridge 262 may include a propellant to launch the wire-tethered electrodes. A cartridge, as discussed above, may be useful for a single deployment or may operate as a magazine for multiple deployments. A cartridge may include a pair of wire-tethered electrodes.

A cartridge 264 may include a wireless electrified projectile, a bug, a sensor, or a biometric circuit as discussed above. A projectile may perform a marking function (e.g., release a dye not apparent to the target, affix a beacon and/or transponder that provides an identifying message for tracking the location of the target).

A signal generator provides a current to inhibit locomotion of the target. A signal generator may, in any order perform one or more of the following operations: select electrodes for use in a stimulus signal delivery circuit, ionize air in a gap between the electrode and the target, provide an initial stimulus signal, provide alternate stimulus signals, and respond to input (e.g., from processor 240) to control any of the aforementioned operations.

In a system that uses a current through target tissue to effect area denial, the current may be provided by any conventional waveform generator. For instance, for launch systems 230, a signal generator 248 of the type described solely in any of the following U.S. patents or in any combination of teachings therein may be used: U.S. Pat. Nos. 3,803,463 to Cover, 5,750,918 to Mangolds, 6,636,412 and 7,057,872 to Smith, and 7,102,870 to Nerheim.

A stimulus signal includes any signal delivered via electrodes to establish or maintain a stimulus signal delivery circuit through the target and/or to inhibit locomotion by the target. The purposes of a stimulus signal may be accomplished with a signal having a plurality of stages. Each stage may comprise a period of time during which one or more pulse waveforms are consecutively delivered via a waveform generator and electrodes coupled to the waveform generator.

Stages from which a complete stimulus signal may be constructed include in any practical order: (a) a path formation stage for ionizing an air gap (e.g., forming an arc across the gap) that may be in series with the electrode to the targets tissue; (b) a path testing stage for measuring an electrical characteristic of the stimulus signal delivery circuit (e.g., whether or not an air gap exists in series with the target's tissue); (c) a strike stage for immobilizing the target; (d) a hold stage for discouraging further motion by the target; and (e) a rest stage for permitting limited mobility by the target (e.g., to allow the target to catch a breath). A repeated stage may have a repetition rate (e.g., to accomplish from 5 to 20 pulses per second, each pulse with arc formation).

The initial voltage may be a relatively high voltage for paths that include ionization to be maintained or a relatively low voltage for paths that do not include ionization. The initial voltage may correspond to a stimulus peak voltage (SPV) without ionization may be from about 100 to about 600 volts, preferably from about 350 volts to about 500 volts, most preferably about 400 volts. The termination voltage may be determined to deliver a predetermined charge per pulse. Charge per pulse minimum may be designed to assure continuous muscle contraction as opposed to discontinuous muscle twitches. Continuous muscle contraction has been observed in human targets where charge per pulse is above about 15 microcoulombs. A minimum of about 50 microcoulombs is used in one implementation. A minimum of 85 microcoulombs is preferred, though higher energy expenditure accompanies the higher minimum charge per pulse.

Charge per pulse maximum may be determined to avoid cardiac fibrillation in the target. For human targets, fibrillation has been observed at 1355 microcoulombs per pulse and higher. The value 1355 is an average observed over a relatively wide range of pulse repetition rates (e.g., from about 5 to 50 pulses per second), over a relatively wide range of pulse durations consistent with variation in resistance of the target (e.g., from about 10 to about 1000 microseconds), and over a relatively wide range of peak voltages per pulse (e.g., from about 50 to about 1000 volts). A maximum of 500 microcoulombs significantly reduces the risk of fibrillation while a lower maximum (e.g., about 100 microcoulombs) is preferred to conserve energy expenditure.

Pulse duration is preferably dictated by delivery of charge as discussed above. Pulse duration according to various aspects of the present invention is generally longer than conventional systems that use peak pulse voltages higher than the ionization potential of air. Pulse duration may be in the range from about 20 to about 500 microseconds, preferably in the range from about 30 to about 200 microseconds, and most preferably in the range from about 30 to about 100 microseconds.

By conserving energy expenditure per pulse, longer durations of immobilization may be effected and smaller, lighter power sources may be used (e.g., in a projectile comprising a battery). In one embodiment, a suitable range of charge per pulse may be from about 50 to about 150 microcoulombs.

Initial and termination voltages may be designed to deliver the charge per pulse in a pulse having a duration in a range from about 30 microseconds to about 210 microseconds (e.g., for about 50 to 100 microcoulombs). A discharge duration sufficient to deliver a suitable charge per pulse depends in part on resistance between electrodes at the target. For example, a one RC time constant discharge of about 100 microseconds may correspond to a capacitance of about 1.75 microfarads and a resistance of about 60 ohms. An initial voltage of 100 volts discharged to 50 volts may provide 87.5 microcoulombs from the 1.75 microfarad capacitor.

A termination voltage may be calculated to ensure delivery of a predetermined charge. For example, an initial value may be observed corresponding to the voltage across a capacitor. As the capacitor discharges delivering charge into the target, the observed value may decrease. A termination value may be calculated based on the initial value and the desired charge to be delivered per pulse. While discharging, the value may be monitored. When the termination value is observed, further discharging may be limited (or discontinued) in any conventional manner. In an alternate implementation, delivered current is integrated to provide a measure of charge delivered. The monitored measurement reaching a limit value may be used to limit (or discontinue) further delivery of charge.

Pulse durations in alternate implementations may be considerably longer than 100 microseconds, for example, up to 1000 microseconds. Longer pulse durations increase a risk of cardiac fibrillation. In one implementation, consecutive strike pulses alternate in polarity to dissipate charge which may collect in the target to adversely affect the target's heart. In another implementation, consecutive strike stages are of alternate polarity.

During the strike stage, pulses are delivered at a rate of about 5 to about 50 pulses per second, preferably about 20 pulses per second. The strike stage continues from the rising edge of the first pulse to the falling edge of the last pulse of the stage for from 1 to 5 seconds, preferably about 2 seconds.

In a hold stage, a voltage waveform is sourced and impressed across a pair of electrodes. Typically this waveform is sufficient to discourage mobility and/or continue immobilization to an extent somewhat less than the strike stage. A hold stage generally demands less power than a strike stage. Use of hold stages intermixed between strike stages permit the immobilization effect to continue as a fixed power source is depleted (e.g., battery power) for a time longer than if the strike stage were continued without hold stages. The stimulus signal of a hold stage may primarily interfere with voluntary control of the target's skeletal muscles as discussed above or primarily cause pain and/or disorientation. The pair of electrodes may be the same or different than used in a preceding path formation, path testing, or strike stage, preferably the same as an immediately preceding strike stage. According to various aspects of the present invention, the shape of the waveform used in a hold stage includes a pulse with decreasing amplitude (e.g., a trapezoid shape) and initial voltage (SPV) as discussed above with reference to the strike stage. The termination voltage may be determined to deliver a predetermined charge per pulse less than the pulse used in the strike stage (e.g., from 30 to 100 microcoulombs). During the hold stage, pulses may be delivered at a rate of about 5 to 15 pulses per second, preferably about 10 pulses per second. The hold stage continues from the rising edge of the first pulse to the falling edge of the last pulse of the stage for from about 20 to about 40 seconds (e.g., about 28 seconds).

A rest stage is a stage intended to improve the personal safety of the target and/or the operator of the system. In one implementation, the rest stage does not include any stimulus signal. Consequently, use of a rest stage conserves battery power in a manner similar to that discussed above with reference to the hold stage. Safety of a target may be improved by reducing the likelihood that the target enters a relatively high risk physical or emotional condition. High risk physical conditions include risk of loss of involuntary muscle control (e.g., for circulation or respiration), risk of convulsions, spasms, or fits associated with a nervous disorder (e.g., epilepsy, or narcotics overdose). High risk emotional conditions include risk of irrational behavior such as behavior springing from a fear of immediate death or suicidal behavior. Use of a rest stage may reduce a risk of damage to the long term health of the target (e.g., minimize scar tissue formation and/or unwarranted trauma). A rest stage may continue for from 1 to 5 seconds, preferably 2 seconds.

In the path formation stage, a waveform shape may include an initial peak (voltage or current), subsequent lesser peaks alternating in polarity, and a decaying amplitude tail. The initial peak voltage may exceed the ionization potential for an air gap of expected length (e.g., about 50 Kvolts, preferably about 10 Kvolts). A subsequent stage immediately follows or overlaps in time so as to maintain the ionization. In one implementation, the path formation stage and strike stage are combined as one compliance waveform (e.g., one pulse), formed as a decaying oscillation from a conventional resonant circuit. One waveform shape having one or more peaks may be sufficient to ionize and maintain ionization of a path crossing a gap (e.g., air). Repetition of applying such a waveform shape may follow a path testing stage (or monitoring concurrent with another stage) that concludes that ionization is needed and is to be attempted again (e.g., prior attempt failed, or ionized air is disrupted).

Examples of the Invention

A system for performing a function with respect to a zone includes a controller, a network, and a plurality of subsystems coupled to the controller via the network. The controller issues a first series of commands. Each command of the first series includes a first ordinal. A particular subsystem of the plurality of subsystems determines a role in accordance with a physical position of the particular subsystem relative to an other subsystem of the plurality of subsystems. The particular subsystem counts commands of the series to determine for a particular command the first ordinal. The particular subsystem performs a function with respect to the zone in accordance with the particular command of the series, in further accordance with the first ordinal, and in further accordance with the role.

A launcher for area denial is coupled to a network. The launcher includes a circuit, a memory, a receiver, and a processor. The circuit couples the launcher to a propellant for propelling a projectile into a zone of the area. The memory includes stored indicia of a role. The receiver receives from the network a series of commands. The processor controls the circuit to launch the projectile in response to a particular command of the series, in accordance with an ordinal of the particular command in the series, and in further accordance with the indicia of the role.

The foregoing description discusses preferred embodiments of the present invention which may be changed or modified without departing from the scope of the present invention as defined in the claims. Listed items in parentheses may be used in the alternative or combined in any manner. While for the sake of clarity of description, several specific embodiments of the invention have been described, the scope of the invention is intended to be measured by the claims as set forth below.

What is claimed is:

1. A first launcher for operation as a member of a plurality of launchers, wherein a provided controller controls the plurality of launchers, the plurality of launchers and the controller communicate via a provided network, the first launcher comprising:

a first detector that detects indicia for detecting a relationship between the first launcher and a second launcher of the plurality of launchers, the relationship for establishing an order for activating a provided cartridge of each respective launcher of the plurality of launchers, the detector positioned at a first position of the first launcher;

a transmitter for transmitting via the network; and a circuit that, responsive to the first detector, detects a role of the first launcher in the order; wherein:

after the first detector detects the relationship, the transmitter transmits a message describing the relationship;

the circuit receives a command via the network; and responsive to the command and in accordance with the role of the first launcher in the order, the circuit provides a signal to activate the cartridge of the first launcher.

2. The first launcher of claim 1 wherein the circuit comprises:

a receiver that receives the command; and a processor that provides the signal responsive to the command.

3. The first launcher of claim 1 wherein:

the first position comprises a top of the first launcher; and the relationship comprises the second launcher positioned above the first launcher.

4. The first launcher of claim 3 wherein:

the order comprises a top-bottom order; and in accordance with the order, the circuit provides the signal after the second launcher activates its respective cartridge.

5. The first launcher of claim 3 wherein:

the order comprises a bottom-top order; and in accordance with the order, the circuit provides the signal before the second launcher activates its respective cartridge.

6. The first launcher of claim 1 further comprising a second detector positioned at a second position on the first launcher, wherein:

after the second detector detects indicia of a third launcher of the plurality of launchers, the transmitter transmits a message describing a relationship between the first launcher and the third launcher; and the relationship between the first launcher and the third launcher is transmitted for further determining the order.

7. The first launcher of claim 6 wherein:

the first position comprises a top of the first launcher;

the second position comprises a bottom of the first launcher; and the relationship comprises the second launcher positioned above the first launcher and the third launcher positioned below the first launcher.

8. The first launcher of claim 7 wherein:

the order comprises a top-middle-bottom order; and in accordance with the order, the circuit provides the signal before the third launcher activates its cartridge and after the second launcher activates its cartridge.

9. The first launcher of claim 7 wherein:

the order comprises a bottom-middle-top order; and in accordance with the order, the circuit provides the signal before the second launcher activates its cartridge and after the third launcher activates its cartridge.

10. The first launcher of claim 1 wherein the indicia comprise an electromagnetic energy.

11. The first launcher of claim 1 wherein the indicia comprise a magnetic flux.

12. The first launcher of claim 1 wherein the first detector comprises a reed switch.

13. The first launcher of claim 1 wherein the first detector comprises an optical detector.

14. The first launcher of claim 1 wherein:

the cartridge comprises at least one wire-tethered electrode; and activating the cartridge launches the at least one wire-tethered electrode toward a target.

15. The first launcher of claim 1 further comprising an indicator positioned proximate to the first detector, wherein the indicator provides indicia to the second launcher.

16. The first launcher of claim 1 further comprising an indicator positioned proximate to the first detector, wherein:

the indicator provides an electromagnetic energy; and the indicia comprises a portion of the electromagnetic energy reflected by the second launcher.

17. The first launcher of claim 1 further comprising an indicator positioned proximate to the first detector, wherein the indicator aligns with a second detector positioned on the second launcher.

18. A method performed by a first launcher of a plurality of launchers for activating a cartridge of the first launcher, the plurality of launchers and a controller communicate via a network, the cartridge activated in accordance with an order for activating a respective cartridge of the one or more launchers of the plurality of launchers, the method comprising:

detecting indicia of an other launcher of the plurality of launchers;

in accordance with detecting the indicia, reporting a relationship between the first launcher and the other launcher, the relationship for determining the order for activating the respective cartridge of each launcher; and responsive to receiving a command formed in accordance with the order, providing a signal to activate the cartridge.

19. The method of claim 18 wherein detecting comprises detecting an electromagnetic energy.

20. The method of claim 18 wherein detecting comprises detecting a magnetic flux.

21. The method of claim 18 wherein detecting comprises:

providing an electromagnetic energy; and detecting a reflected portion of the electromagnetic energy.

22. The method of claim 18 wherein detecting comprises:

detecting indicia from a second launcher of the plurality of launchers positioned above the first launcher; and detecting indicia from a third launcher of the plurality of launchers positioned below the first launcher.

23. The method of claim 22 wherein reporting comprises transmitting a message describing that the second launcher is positioned above the first launcher and the third launcher is positioned below the first launcher.

24. The method of claim 18 wherein reporting comprises transmitting a message.

25. The method of claim 24 wherein the message describes the relationship.

26. The method of claim 18 wherein:

a detector positioned at a first position on the first launcher accomplishes detecting; and reporting comprises determining the relationship in accordance with the first position.

27. The method of claim 18 wherein the order comprises a temporal sequence for activating the cartridge of each launcher of the plurality of launchers.

28. The method of claim 18 wherein the relationship comprises a physical position of the first launcher relative to the other launcher.

29. The method of claim 18 wherein the relationship comprises a temporal arrangement between the first launcher and the other launcher.

30. The method of claim 18 wherein the relationship comprises an electrical arrangement between the first launcher and the other launcher.

31. The method of claim 18 wherein providing the signal in accordance with the order comprises providing the signal before the other launcher activates its cartridge.

32. The method of claim 18 wherein providing the signal in accordance with the order comprises providing the signal after the other launcher activates its cartridge.

33. The method of claim 18 wherein providing the signal in accordance with the order comprises providing the signal simultaneously as the other launcher activates its cartridge.

* * * * *